United States Patent [19]

Turnbull

[11] Patent Number: 4,555,150

[45] Date of Patent: Nov. 26, 1985

[54] WORK STATION

[75] Inventor: Clyde D. Turnbull, Chicago, Ill.

[73] Assignee: Hunt Manufacturing Co., Philadelphia, Pa.

[21] Appl. No.: 570,948

[22] Filed: Jan. 16, 1984

[51] Int. Cl.[4] ..... A47B 83/04

[52] U.S. Cl. ..... 312/250; 312/195; 312/201

[58] Field of Search ..... 312/250, 201, 194, 195, 312/203, 205, 140.1-140.4; 108/64, 93, 59, 102

[56] References Cited

U.S. PATENT DOCUMENTS

| | | | |
|---|---|---|---|
| 2,545,253 | 3/1951 | Bergson | 312/30 |
| 3,920,298 | 11/1975 | Lopez | 312/195 |
| 4,433,884 | 2/1984 | Edwards et al. | 312/250 |

FOREIGN PATENT DOCUMENTS

| | | | |
|---|---|---|---|
| 33471 | 9/1928 | France | 312/201 |

*Primary Examiner*—William E. Lyddane
*Assistant Examiner*—Joseph Falk
*Attorney, Agent, or Firm*—John F. A. Earley; John F. A. Earley, III

[57] ABSTRACT

A work station has a first substantially rectangular table having a top and supports for the top adjacent the ends of the top. A second substantially rectangular table is secured at a substantially right angle to the first table top with the rear edge of the second table top substantially aligned with the edge of one end of the first table top. The upper surface of the second table top lies in a plane below the plane of the lower surface of the first table top. A movable storage cabinet has a top which has a height and depth substantially equal to the height and depth of the second table top respectively for alternatively serving as an extension of the second table top or nesting under the first table top adjacent the end thereof remote from the second table. Advantageously the movable storage cabinet is mounted on supports such as casters which facilitate the movement of the cabinet on a floor. Advantageously the width of the first table top is at least 24" greater than the sum of the depth (front to back) of the second table top and the width of the movable storage cabinet to provide easy access to the first table by the user even when the movable storage cabinet is nested under it. It is preferred to have the height of the second table about 26 and ½" and the width of the second table top from about 60% to about 75% of the width of the first table top.

4 Claims, 2 Drawing Figures

WORK STATION

TECHNICAL FIELD

This invention is in the furniture field.

BACKGROUND OF THE PRIOR ART

Work stations employing rectangular tables at right angles to each other sometimes at different elevations are known to the art as are storage cabinets mounted on casters or the like to facilitate their movement. Such work stations are commonly employed, for example, by secretaries using word processors with a keyboard placed on one table and a cathode ray tube display device placed on the other table. Such work stations normally have a storage cabinet fixedly secured to one of the tables. At times the working surface of such work stations is inadequate and it is therefore desirable to be able to temporarily increase the working surface. This problem has been solved by the instant invention by providing a movable storage cabinet which can serve to extend the working surface when needed and which can be nested under one of the tables when it is not needed.

BRIEF SUMMARY OF THE INVENTION

A work station has a first substantially rectangular table having a top and supports for the top adjacent the ends of the top. A second substantially rectangular table is secured at a substantially right angle to the first table top with the rear edge of the second table top substantially aligned with the edge of one end of the first table top. The upper surface of the second table top lies in a plane below the plane of the lower surface of the first table top. A movable storage cabinet has a top which has a height and depth substantially equal to the height and depth of the second table top respectively for alternatively serving as an extension of the second table top or nesting under the first table top adjacent the end thereof remote from the second table. Advantageously the movable storage cabinet is mounted on supports such as casters which facilitate the movement of the cabinet on a floor. Advantageously the width of the first table top is at least 24" greater than the sum of the depth (front to back) of the second table top and the width of the movable storage cabinet to provide easy access to the first table by the user even when the movable storage cabinet is nested under it. It is preferred to have the height of the second table about 26 and ½" and the width of the second table top from about 60% to about 75% of the width of the first table top.

DETAILED DESCRIPTION

Figure 2:
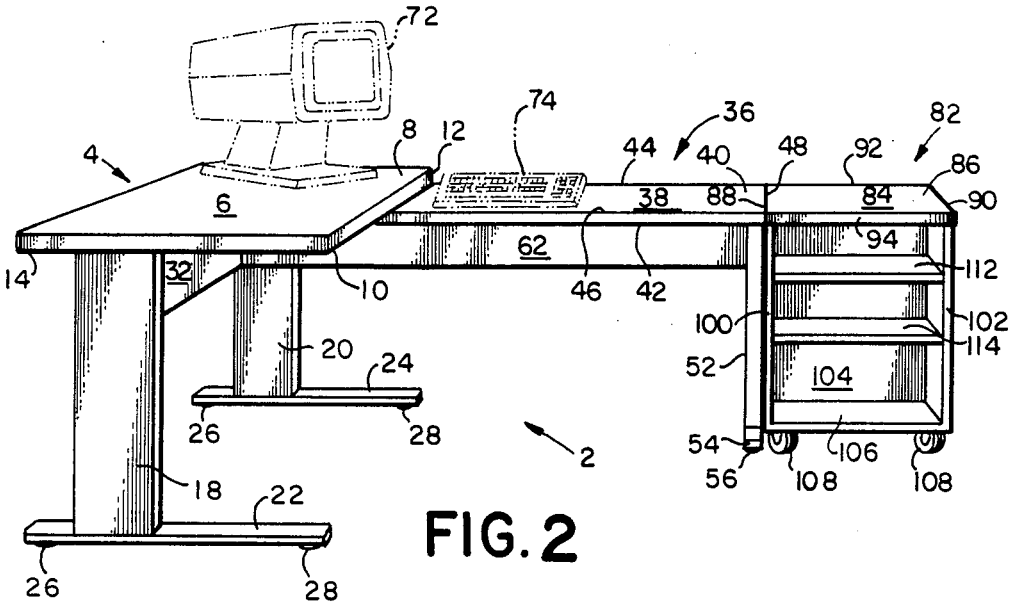
FIG. 2 is a side perspective view of the work station of FIG. 1 with the storage cabinet positioned to extend the working surface of the work station.
Figure 1:
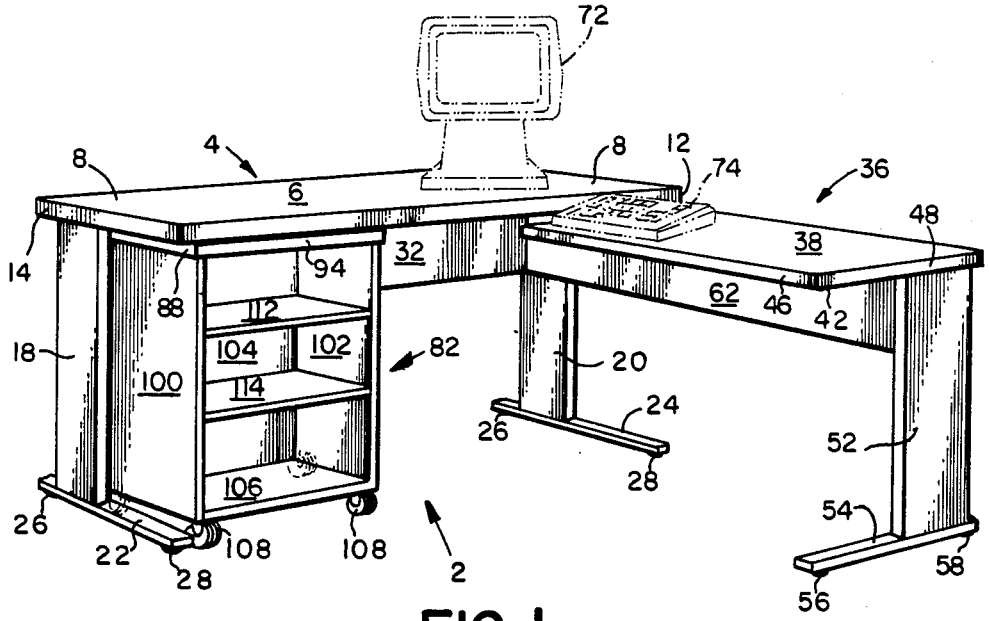
FIG. 1 is a front perspective view of a work station in accordance with the invention with the storage cabinet nested.

A work station 2 in accordance with the invention has a table 4 having a rectangular top 6 with a top surface 8, a bottom surface 10, and end edges 12 and 14. Top 6 is supported on legs 18 and 20 secured to opposite ends of top 6 and in turn mounted on bars 22, 24 each having a rear support pad 26 and a front support pad 28.

A transverse strength member 32 is connected to legs 18 and 20 and to top 6.

A second table 36 has a rectangular top 38 with an upper surface 40, a lower surface 42, a rear edge 44, a front edge 46, and a right edge 48. Top 38 has its rear edge 44 in the same vertical plane as the end edge 12 of table top 6 and its upper surface 40 lies below the lower surface 10 of table top 6. Top 38 is supported at its righthand end by a leg 52 secured to top 40 and mounted on a bar 54 having a front support pad 56 and a rear support pad 58. A transverse strength member 62 is secured to leg 52 and top 40 as well as to strength member 32 and leg 20.

A video tube viewing device 72 is shown in phantom resting on table top 6 and a word processor keyboard 74 is shown in phantom resting on table top 38.

Advantageously the depth (front to back) of table top 38 will be from about 25% to about 35% of the width of table top 6.

A movable storage cabinet 82 has a rectangular top 84 with a top surface 86, a left edge 88, a right edge 90, a rear edge 92, and a front edge 94. Top 84 is mounted on opposed side panels 100 and 102 and rear panel 104, each of which panels is secured to a bottom panel 106. Movable storage cabinet 82 is mounted on four casters 108, the lefthand casters being secured to panel 100 and the righthand casters being secured to panel 102. A pair of spaced shelves 112 and 114 are secured to side panels 100 and 102.

The top surface 84 of cabinet 82 lies in the same plane as the top surface 40 of table 36. The depth (front to back) of top 84 is the same as the depth (front to back) of top 38.

When cabinet 82 has its edge 88 rolled against edge 48 of table 36 with its rear edge 92 in alignment with rear edge 44 of table 36, cabinet 82 forms an extension of the work surface of table 36 with table top 38 being in the same plane as the top 84 of cabinet 82. Alternatively when the extension of table 36 is not required, the cabinet 82 can be moved under table top 6 adjacent left leg 18. In this position it still permits the person using the work station to move a chair to a position facing table 4. In both positions, cabinet 82 retains fully its storage use.

In a typical example top 6 will have a width of 66", a depth of 30" and a height of 29"; top 38, a width of 40", a depth of 22" and a height of 26 and ½"; and top 84, a width of 20", a depth of 22" and a height of 26 and ½".

It will be understood that the above description is illustrative and is not intended to be limiting except as set forth in the following claims.

I claim:

1. A work station comprising:

a first table having a substantially rectangular top with upper and lower surfaces and means for supporting the top adjacent the ends of the top, a second table having one end secured to the first table at a substantially right angle thereto having a substantially rectangular top with upper and lower surfaces and with the rear edge of the second table top being substantially aligned with the edge of one end of the first table top, and the upper surface of the second table top lying in a plane below the plane of the lower surface of the first table top, and a movable storage cabinet having a top which has a height substantially equal to the height of said second table top and a depth substantially equal to the depth of the second table top respectively for alternatively serving as an extension of the second table by positioning the storage cabinet so it is adjacent to the end of the second table top opposite the end that is secured to the first table or nesting under the first table top adjacent the end thereof remote from the second table.

2. A work station in accordance with claim 1 in which the movable storage cabinet has at each corner of the bottom thereof means for facilitating the movement of the cabinet on a floor.

3. A work station in accordance with claims 1 or 2 in which the height of the second table is about 26 and $\frac{1}{2}''$.

4. A work station in accordance with claims 1 or 2 in which the width of the first table top is greater than the sum of the depth of the second table top and the width of the movable storage cabinet by at least 24".

* * * * *